US008813283B2

(12) United States Patent
Alexander

(10) Patent No.: US 8,813,283 B2
(45) Date of Patent: Aug. 26, 2014

(54) SUPPLEMENTAL SLEEPING PILLOW WITH DETACHABLE STRAP

(71) Applicant: Gloria Alexander, Kansas City, MO (US)

(72) Inventor: Gloria Alexander, Kansas City, MO (US)

( * ) Notice: Subject to any disclaimer, the term of this patent is extended or adjusted under 35 U.S.C. 154(b) by 0 days.

(21) Appl. No.: 13/903,314

(22) Filed: May 28, 2013

(65) Prior Publication Data

US 2014/0000034 A1 Jan. 2, 2014

Related U.S. Application Data

(60) Provisional application No. 61/666,475, filed on Jun. 29, 2012.

(51) Int. Cl.
*A47C 20/00* (2006.01)

(52) U.S. Cl.
USPC ..... 5/636; 5/655.9

(58) Field of Classification Search
CPC ..... A47G 9/10; A47G 9/1081; A47G 2009/1018; A61G 13/121; A61G 7/072; A61G 1/044; A61G 15/125; A47C 7/383; A47C 16/00; A47C 27/056
USPC ..... 5/657, 636, 637, 639, 640, 922
See application file for complete search history.

(56) References Cited

U.S. PATENT DOCUMENTS 1,664,537 A 4/1928 Blankinship
3,103,219 A * 9/1963 Chadner ..... 607/109
3,299,451 A 1/1967 Trogdon
3,578,383 A * 5/1971 Earl ..... 297/391
3,949,437 A * 4/1976 Gritsch ..... 5/643
4,768,247 A 9/1988 Beier
5,015,036 A * 5/1991 Fergie ..... 297/397
D330,989 S * 11/1992 Evans ..... D6/601
5,503,456 A * 4/1996 Rossini ..... 297/397
5,544,378 A * 8/1996 Chow ..... 5/644
5,566,682 A * 10/1996 Yavitz ..... 5/630
5,581,831 A * 12/1996 Xiang ..... 5/636
5,586,350 A * 12/1996 Thonnessen et al. ..... 5/636
5,829,079 A * 11/1998 Castro ..... 5/636
5,918,332 A * 7/1999 Dees ..... 5/639
6,231,535 B1 * 5/2001 Mainiero et al. ..... 602/18
6,347,421 B1 2/2002 D'Emilio
6,484,335 B2 * 11/2002 Gilbert ..... 5/636
6,625,829 B2 * 9/2003 Zell ..... 5/637
6,748,615 B1 * 6/2004 Tiedemann ..... 5/640
D505,291 S * 5/2005 Dalset ..... D6/601
6,957,462 B1 * 10/2005 Wilcox ..... 5/636
7,165,279 B1 * 1/2007 Georgescu ..... 5/636

(Continued)

*Primary Examiner* — Nicholas Polito
*Assistant Examiner* — Richard G Davis
(74) *Attorney, Agent, or Firm* — Daniel Boudwin; Global Intellectual Property Agency LLC

(57) ABSTRACT

A supplemental pillow for preventing the hair of a user from making contact with a sleeping surface is provided. The pillow includes a cylindrical body, an elevated middle section, and a detachable strap. The pillow can be positioned under a conventional sleeping pillow to create an elevated sleeping surface. The strap can be used to transport the pillow, condense the pillow for storage or travel, or secure the pillow to a conventional sleeping pillow. The elevated middle section is made of a less dense filler than the body of the pillow, which provides a soft sleeping surface. The middle section also acts as a wedge against a user's neck to retain the positioning of the pillow on top of the sleeping pillow when the detachable strap is not in use.

5 Claims, 3 Drawing Sheets

(56) References Cited

U.S. PATENT DOCUMENTS

| | | | | |
|---|---|---|---|---|
| D543,066 | S * | 5/2007 | Ohno | D6/601 |
| 7,441,292 | B2 | 10/2008 | Williams | |
| 7,832,034 | B2 * | 11/2010 | Liu et al. | 5/636 |
| 8,316,855 | B2 * | 11/2012 | Lee | 128/845 |
| 8,656,538 | B2 * | 2/2014 | Holyfield | 5/640 |
| 2001/0049844 | A1 * | 12/2001 | Gilbert | 5/636 |
| 2003/0037376 | A1 * | 2/2003 | Zell | 5/636 |
| 2004/0003469 | A1 * | 1/2004 | Gill-Barajas | 5/636 |
| 2004/0107502 | A1 * | 6/2004 | Boone | 5/636 |
| 2006/0064819 | A1 | 3/2006 | Mollett | |
| 2007/0067915 | A1 * | 3/2007 | Pryor | 5/636 |
| 2010/0077551 | A1 * | 4/2010 | Liu et al. | 5/636 |
| 2011/0061166 | A1 * | 3/2011 | Liu | 5/636 |
| 2013/0047338 | A1 * | 2/2013 | Lin | 5/636 |
| 2013/0117939 | A1 * | 5/2013 | Moss | 5/644 |
| 2013/0232693 | A1 * | 9/2013 | Myers | 5/636 |

* cited by examiner

SUPPLEMENTAL SLEEPING PILLOW WITH DETACHABLE STRAP

CROSS REFERENCE TO RELATED APPLICATION

This application claims the benefit of U.S. Provisional Application No. 61/666,475 filed on Jun. 29, 2012, entitled "Sleep Pretty Pillow." The above identified patent application is herein incorporated by reference in its entirety to provide continuity of disclosure.

BACKGROUND OF THE INVENTION

1. Field of the Invention

The present invention relates to pillows. More particularly, the present invention pertains to a supplemental pillow that is removably attached to a conventional sleeping pillow to elevate the head of the user to prevent his or her hair from making contact therewith.

Many people enjoy having their hair styled at a salon. This can be for special occasions, such as for attending a wedding, party, or night out on the town. Alternately, many people will take a weekly trip to the salon to have their hair shampooed and styled by a hair stylist. The difficulty encountered in such situations relates to extending the length of time with which the hair style lasts. As can be appreciated, sleeping usually entails resting one's head on a pillow for an extended period of time. This can cause the hair style to become frizzy, matted, or pulled out of place during the night.

To prevent such occurrences, many individuals will attempt to sleep in a position that prevents direct contact between the hair and pillow or bed. Some people attempt to prop their head, neck, and shoulders up throughout the night. This, however, can lead to strained muscles and subsequent soreness of the individual's neck. Others may attempt to sleep in an upright position. This, however, is impractical for many people, as sleeping in an upright position for an extended period of time can become uncomfortable and lead to poor sleep. A third solution is to position a conventional pillow so that the hair and pillow do not make direct contact with each other. As a person sleeps, however, the pillow tends to shift about and come into contact with the hair.

The present invention overcomes the problems inherent in preventing contact between the hair and pillow or bed. The device comprises a cylindrical pillow with an elevated section in the middle. The elevated section raises the head of the user and allows the hair to hang over the edge thereof, which prevents the hair from touching the pillow. A detachable strap can be used for carrying the device, and for compressing the pillow for transport. The pillow can additionally include a higher density body, and a lower density elevated section, which prevents the pillow from compressing while still providing a soft sleeping surface. The present invention may be used in conjunction with a conventional sleeping pillow to support the neck while preventing contact between the pillow and hair. This provides a user with a comfortable way to sleep at night while preserving one's hairstyle.

2. Description of the Prior Art

Devices have been disclosed in the prior art that relate to pillows. These include devices that have been patented and published in patent application publications. These devices generally relate to head supports for sleeping. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 3,299,451 to Trogdon discloses a convertible pillow that can be changed from a conventional shape to one having a generally cylindrical shape. The pillow is preferably formed of cellular elastomeric material and comprises a comparatively flat member having a rectangular cross section in its normal shape. A closure means or cover may be placed over the pillow and manipulated in a manner which will change the pillow to one having a generally cylindrical shape, which may be used as a bolster pillow. While the Trogdon device discloses a cylindrical pillow, it does not, however, disclose an elevated middle section, a means of attaching to a conventional sleeping pillow, or a detachable strap.

U.S. Pat. No. 1,664,537 to Blankinship discloses a sleeping pillow having a core comprising a spring construction in place of conventional feathers or other pillow material. The pillow includes a generally cylindrical shape. The spring construction provides a high cushion quality that will not flatten or degrade over time. Similar to Trogdon, the '537 device discloses a cylindrical pillow, and does not disclose an elevated middle section, a dual density body, or a means of attaching to a conventional pillow.

U.S. Pat. No. 7,441,292 to Williams discloses a pillow for coupling to a surface. The pillow includes a first cushion, a first cover enclosing the first cushion, and a second cover enclosing the first cover. The second cover includes a first end with a first corner; a second end that is disposed opposite the first end with a second corner, and a first aperture disposed near the first corner. The first aperture is large enough to permit ingress and egress of the first cushion therethrough. The device further includes an elongated band member that is coupled to the first and second ends, thereby forming an opening between the elongated band member and the second cover, a loop member coupled to the second end, a carrying strap member coupled to the first and second corner, a pair of D-rings coupled to the first and second corner, and a slide fastener. The '292 device is generally square in shape, and does not disclose a cylindrical shaped pillow with an elevated middle section, or a means of attaching to a conventional sleeping pillow.

U.S. Patent Application Publication No. 2006/0064819 to Mollett discloses an orthopedic, therapeutic, memory foam pillow including upper and lower sections made of memory foam. The pillow is crescent shaped and has a quarter-round cutout in the bottom section to accommodate a user's head. In between the upper and lower memory foam sections is an irregularly shaped firmer foam section that is thicker above the cutout and narrower towards the rear curvature of the crescent. The pillow is reversible and can be used with the quarter-round cutout facing upwards or turning the pillow so that the flat surface is upwards. The head can be placed on either the thicker end of the pillow or on the thinner end of the pillow and on either side of the pillow. The Mollett device provides a means of preventing the hair of the user from making contact with a pillow, however the structure of the device differs considerably from the present invention. Mollett utilizes a crescent shape, while the present invention has a cylindrical shape with an elevated middle section.

U.S. Pat. No. 4,768,247 to Beier discloses a travel pillow comprising a pillow casing having compressible material contained therein which is positioned within a flexible plastic bag. One end of the flexible plastic bag includes a zipper to enable the bag to be closed. A one-way air valve is provided at the other end of the bag to permit air within the bag and the pillow to be exhausted outwardly so that the thickness of the pillow may be reduced. The '247 device discloses a travel pillow with a strap that enables the device to be compressed for storage. This device is generally rectangular, and is not adapted to raising the head of the user off of the pillow.

Finally, U.S. Pat. No. 6,347,421 to D'Emilio discloses a sheet material fabric support which is formed into an hourglass shape with two mirror image sections surrounded by a zipper which closes the support to form an inner pocket. Two right circular cylindrical cushions form pillow portions made of an inner core of foam-rubber encased by an outer woven cotton layer that is mounted to the sections within the periphery. A carrying strap is attached to the support for carrying the zipped pillow. This device provides a central area comprising an hourglass shape for resting the head. It does not disclose a cylindrical shape with an elevated middle section.

The devices disclosed in the prior art provide pillows of varying shape and configuration. These devices are generally intended for supporting the head while resting or sleeping. The present invention, however, elevates the head of the user off of the pillow, thereby preventing his or her hair from making contact therewith. This prevents the hairstyle of the user from flattening out during sleep. The present invention accomplishes this with a cylindrical pillow having an elevated middle section. The elevated middle section provides additional space between the user and the sleeping surface. Additionally, the device can be removably attached to a conventional pillow for increasing the distance between the head and the sleeping surface.

In light of the prior art and the disclosed elements of the present invention, it is submitted that the present invention substantially diverges in design elements from the prior art. Consequently, it is clear that the present invention is not described by the art and that a need exists for a supplemental pillow that elevates the head to prevent a user's hair from making contact therewith. In this regard, the instant invention substantially fulfills these needs.

SUMMARY OF THE INVENTION

In view of the foregoing disadvantages inherent in the known types of pillows now present in the prior art, the present invention provides a new pillow wherein the same can be utilized for providing convenience for the user when preventing a users hair from becoming frizzy, matted, or pulled out of place during the night.

It is therefore an object of the present invention to provide a new and improved pillow that has all of the advantages of the prior art and none of the disadvantages.

It is another object of the present invention to provide a new and improved pillow that includes a cylindrical body and an elevated middle section that raises the head of the user off of the sleeping surface to allow the hair to hang over the edge thereof.

Another object of the present invention is to provide a new and improved pillow that includes a detachable strap that is used to transport the pillow, condense the pillow for storage or travel, or secure the pillow to a conventional sleeping pillow.

Yet another object of the present invention is to provide a new and improved pillow that can be constructed in a variety of sizes to coincide with the size of the sleeping pillow.

Another object of the present invention is to provide a new and improved pillow that can be rotated so that the elevated middle section makes contact with the top of the sleeping pillow to prevent the device from rotating while sleeping.

Still another object of the present invention is to provide a new and improved pillow that includes a high-density body, while the elevated middle section is constructed of a less dense filler material to provide a soft sleeping surface.

A final object of the present invention is to provide a new and improved pillow that that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
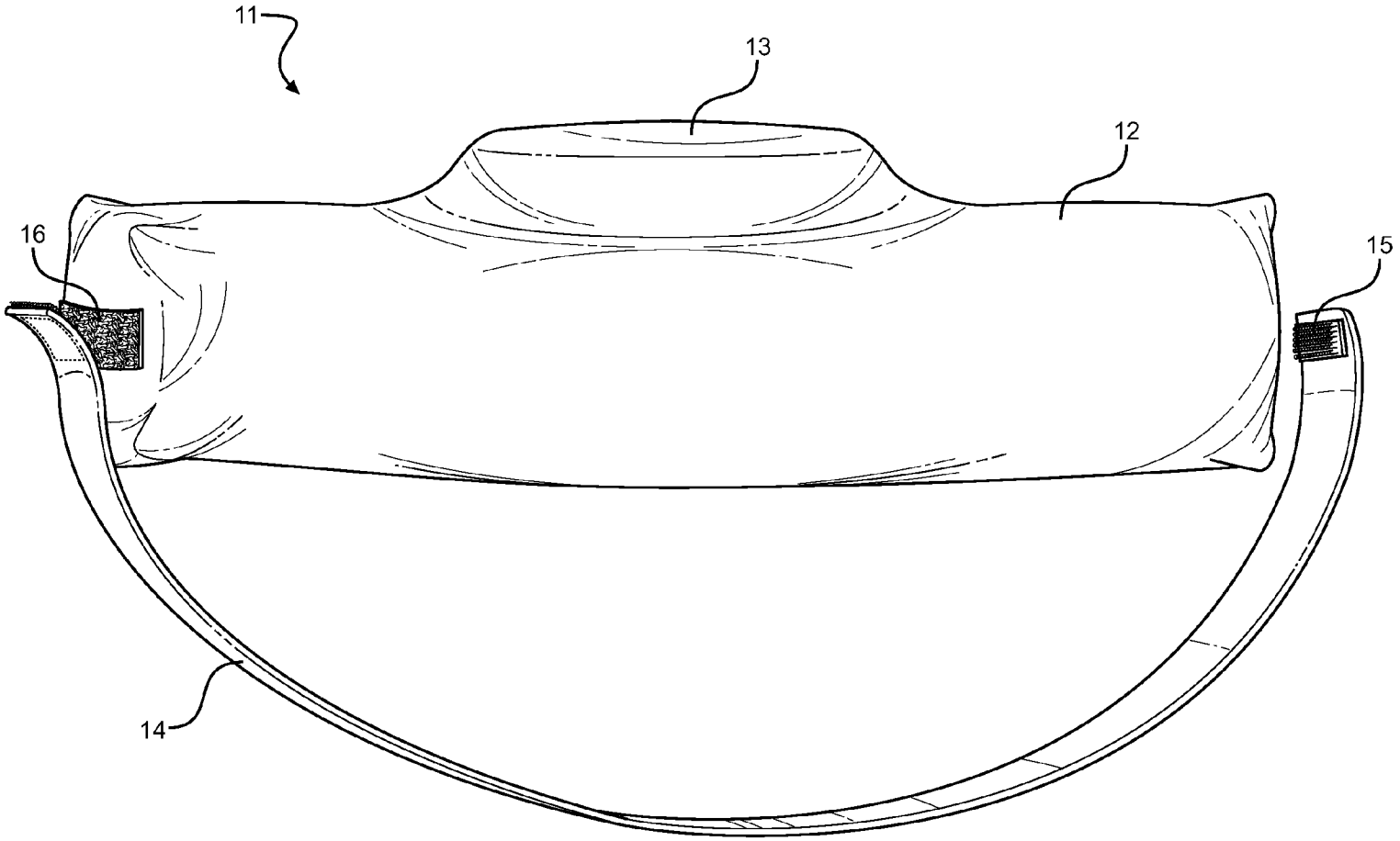
FIG. 1 is a frontal view of the present invention with the elevated middle section facing up, and the detachable strap in position.

Reference is made herein to the attached drawings. Like reference numerals are used throughout the drawings to depict like or similar elements of the present pillow device. For the purposes of presenting a brief and clear description of the present invention, the preferred embodiment will be discussed as used for preventing the hair of a user from making contact with a pillow or bed or being matted between the user's head and a conventional pillow. The figures are intended for representative purposes only and should not be considered to be limiting in any respect.

Referring now to FIG. 1, there is shown a view of the present invention, wherein the device comprises of a pillow structure 11 having a cylindrical body 12 having an elongated section, an interior volume, and a first and second end. Along the body section is an elevated middle section 13 that is adapted to support a user's neck and prevent pillow rotation during the night. The elevated section 13 raises the head of the user above of the sleeping surface, thereby allowing the hair to hang over the edge of the pillow body 12. Users can position themselves on the pillow so that the hair is not resting under the pillow or sleeping surface, thereby preventing it from becoming frizzy, matted, or pulled out of place during the night. The cylindrical shape provides support to the head and neck without applying pressure to the hair. The pillow is preferably smaller than a conventional sleeping pillow, which allows it to be positioned on top thereof. This is particularly beneficial for users who sleep with multiple pillows stacked on top of one another. The pillow may be constructed of cotton, satin, or another suitable material, while the outside of the pillow may include a variety of colors and designs to suit user preference.

The pillow can additionally include a detachable strap 14 that is used to transport the pillow, condense the pillow for storage or travel, or secure the pillow to a conventional sleeping pillow. The strap can be constructed of an elastic material, and secures to either end of the pillow with an attachment means. In the preferred embodiment, the attachment means comprises a hook and loop fastener. The hook 15 material on the ends of the strap can mate with a loop 16 material on either end of the pillow. The loop material is preferably affixed to the pillow, thereby preventing the exposed hook material from chaffing a user while sleeping.

Figure 2:
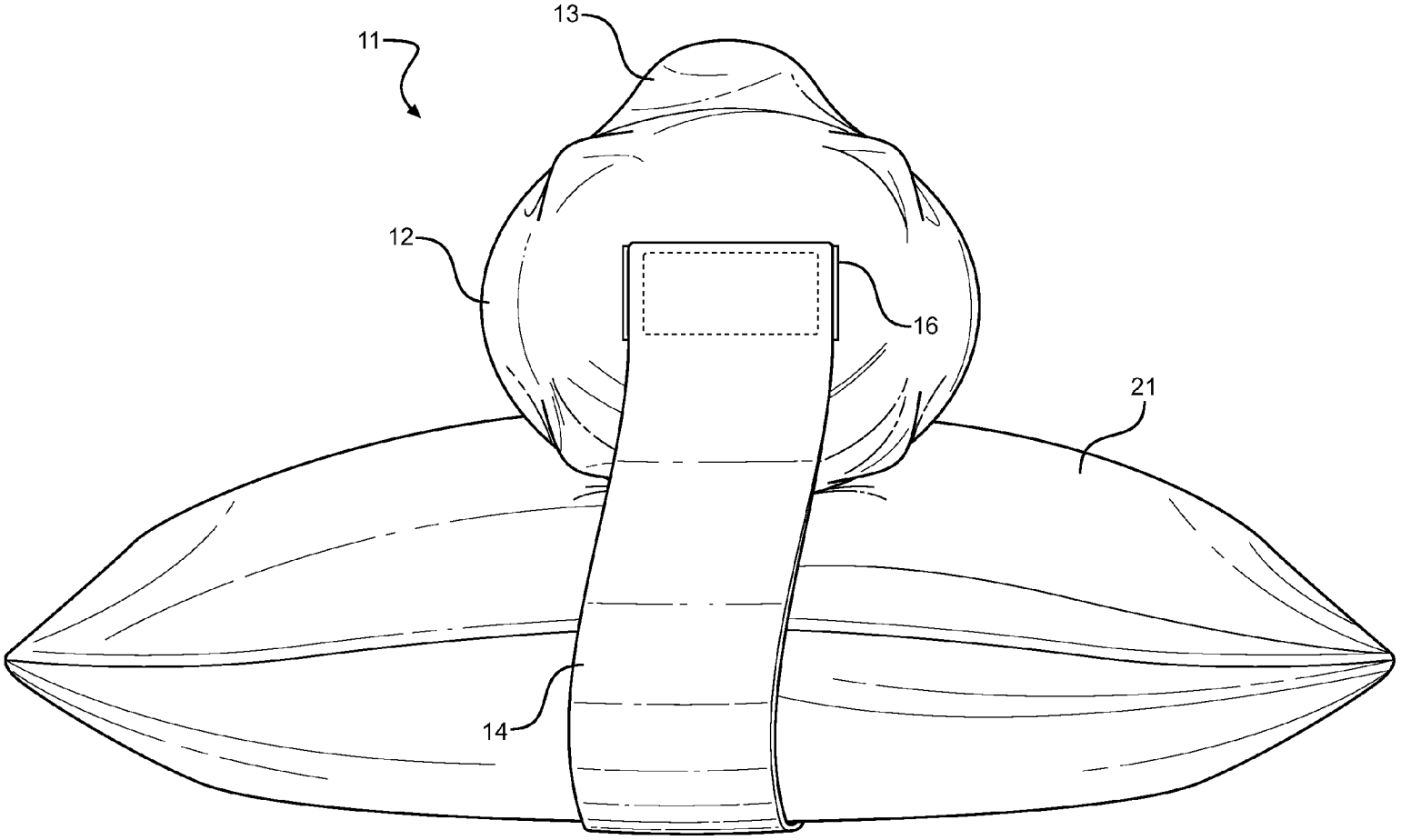
FIG. 2 is a side view of the present invention, wherein the device is secured to a conventional sleeping pillow with a detachable strap.

Referring now to FIG. 2, there is shown a side view of the present invention, wherein the device is secured to a conventional sleeping pillow with a detachable strap. In addition to storage and transport, the strap 14 can be used to securely fasten the pillow 11 to the upper surface of a conventional sleeping pillow 21. The strap can be attached to the loop 16 material on a first end of the pillow, placed under the sleeping pillow, and attached to the loop material on a second end of the pillow. The strap is preferably of a suitable length to apply pressure to the sleeping pillow when positioned thereon. The elastic nature of the strap allows it to stretch to fit around the sleeping pillow, thereby ensuring a secure connection therebetween. The pillow can be constructed in a variety of sizes to coincide with the size of the sleeping pillow. As can be appreciated, conventional sleeping pillows are available in differing sizes based on the size of the bed the pillow is to be used in. The present invention pillow is preferably of similar length to the sleeping pillow it is placed on top of, which ensures a secure connection therebetween.

The strap positions the present invention on top of the sleeping pillow so that the elevated middle section 13 is facing vertically. This positions the pillow in an ideal position for supporting the head and neck of the user. If a user desires to position the elevated middle section at a different angle, the strap can be removed, and the pillow can be rotated. The cylindrical configuration of the body 12 enables a user to orient the pillow so that the elevated middle section is at any angle. The pillow can additionally be rotated so that the elevated middle section makes contact with the top of the sleeping pillow. In this configuration, the elevated middle section serves as a wedge, which helps to retain the positioning of the pillow on top of the sleeping pillow when the strap is not in use. The elevated middle section acts as wedge against the user's neck, thereby preventing the pillow from rotating due to its otherwise cylindrical configuration.

Figure 3:
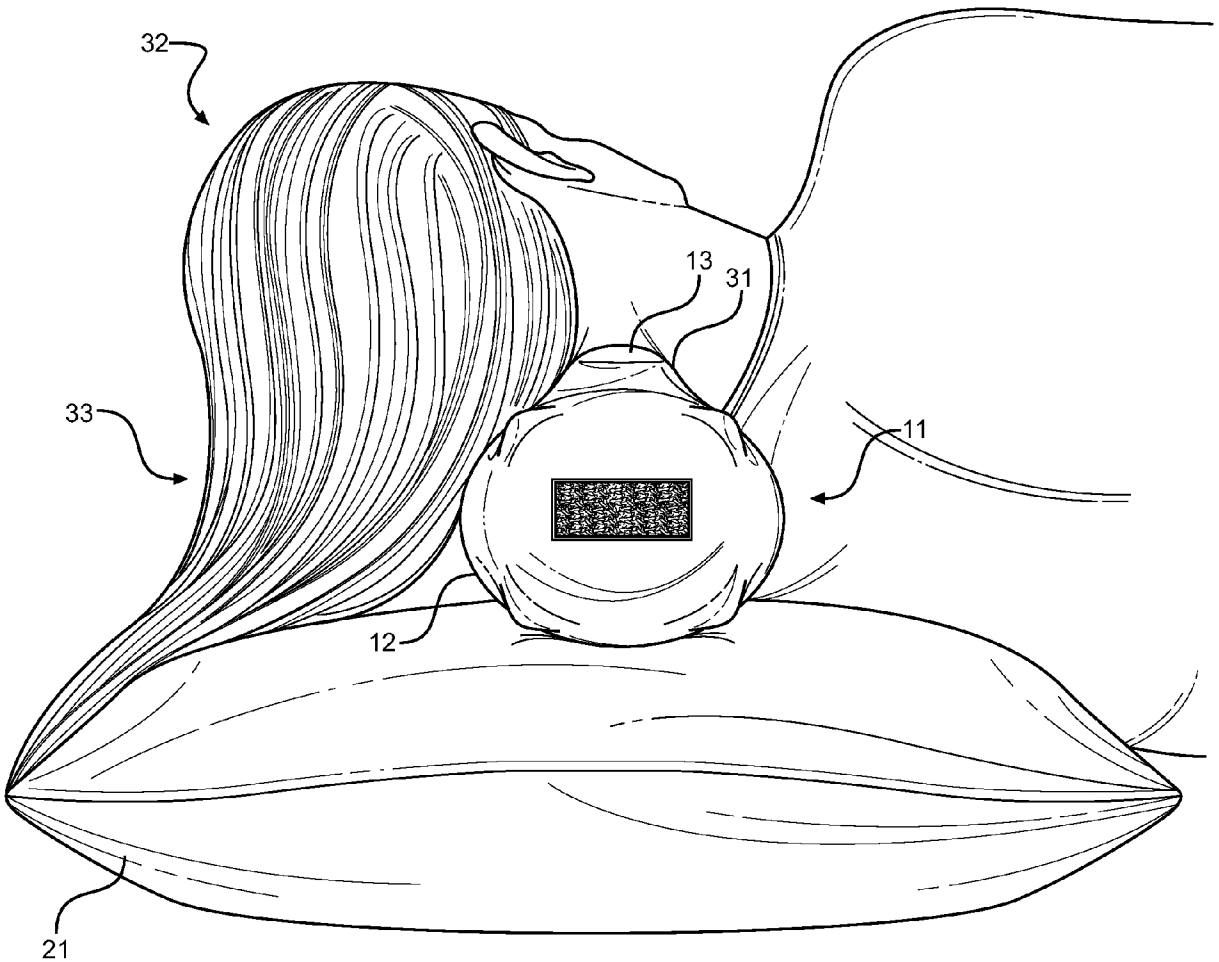
FIG. 3 is a view of the present invention in use, wherein the device is positioned on a conventional sleeping pillow, and a user is resting thereon.

Referring now to FIG. 3, there is shown a view of the present invention in use, wherein the device is positioned on a conventional sleeping pillow, and a user is resting thereon. In operation, the pillow 11 can be positioned on top of a conventional sleeping pillow 21, with the elevated middle section 13 oriented as desired. When facing vertically, the elevated middle section fits the contours of the neck 31 to provide support thereto. In the preferred embodiment, the present invention is constructed of varying density filler material, wherein the filler material may comprise different foams, cotton filler, or polyester filler material. The body 12 of the pillow includes a high-density filler to create a firm sleeping surface, while the elevated middle section is preferably constructed of a less dense filler. This prevents the body of the pillow from compressing or sagging when the weight of the user is resting thereon, while at the same time providing a soft sleeping surface at the elevated middle section. The pillow raises the head 32 of the user so that the user's hair 33 does not make direct contact therewith. The user can spread his or her hair out so that it does not become frizzy, matted, or pulled out of place while sleeping. If a user desires to sleep on a section of the pillow with higher firmness, he or she can rotate the pillow so that the middle section makes contact with the sleeping pillow. This ensures that the pillow will not roll away while the user sleeps. Alternately, the user can attach the detachable strap under the sleeping pillow to create a secure connection therebetween.

Overall, the present invention provides a pillow that helps to preserve the hairstyle of a user without allowing the hair to become frizzy, matted, or pulled out of place during the night. The pillow raises the head so that users are not sleeping directly on top of their hair. The high-density body of the pillow provides firm support, while the less dense elevated middle section provides a soft sleeping surface. The detachable strap can be used to store, transport, and secure the device to a conventional sleeping pillow. The pillow may be constructed of cotton, satin, or another suitable material, and may be offered in a variety of colors and designs to suit user preference. This provides a user with a comfortable way to sleep at night while preserving one's hairstyle.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A supplemental pillow for preventing the hair of a user from making contact with a sleeping surface, comprising:

an elongated and rounded pillow body having an interior volume, a first end and a second end;

said interior volume having a first filler material;

said pillow body having an elevated middle section extend from said pillow body for supporting a user's neck, said middle section having height and an internal volume having a second filler material;

wherein said first filler material is more dense than said second filler material to maintain said middle section elevated above said pillow body;

a single piece elastic detachable strap having an elongated length and a first end and a second end, wherein each of said ends of said detachable strap comprises a fastener;

said first end of said detachable strap adapted to removably attach to said first end of said pillow body;

said second end of said detachable strap adapted to removably attach to said second end of said pillow body;

said detachable strap placed around a conventional sleeping pillow to create a secure connection therewith.

2. The device of claim 1, wherein said pillow body is adapted for placement over a conventional sleeping pillow to elevate a user's neck and head above said conventional sleeping pillow.

3. The device of claim 1, wherein said fastener comprises a hook and loop fastener connection.

4. The device of claim 1, wherein said fastener comprises a hook fastener affixed to a first and second end of said detachable strap, and a loop fastener affixed to a first and second end of said pillow body.

5. The device of claim 1, wherein said elevated middle section is adapted for use as a wedge against a user's neck that retains the positioning of said pillow body on top of a conventional sleeping pillow.

* * * * *